US007757342B2

(12) United States Patent
Gordon et al.

(10) Patent No.: US 7,757,342 B2
(45) Date of Patent: Jul. 20, 2010

(54) CLEANING MACHINE FOR CLEANING A SURFACE

(75) Inventors: Evan A. Gordon, Canton, OH (US); Sergey V. Makarov, Solon, OH (US); Aaron P. Tondra, North Canton, OH (US); Michael A. Durbin, Massillon, OH (US); Robert W. Bauman, North Canton, OH (US)

(73) Assignee: Techtronic Floor Care Technology Limited, Road Town, Tortola (VG)

( * ) Notice: Subject to any disclaimer, the term of this patent is extended or adjusted under 35 U.S.C. 154(b) by 26 days.

(21) Appl. No.: 11/827,039

(22) Filed: Jul. 10, 2007

(65) Prior Publication Data

US 2007/0256270 A1 Nov. 8, 2007

Related U.S. Application Data

(62) Division of application No. 10/698,149, filed on Oct. 30, 2003, now Pat. No. 7,392,566.

(51) Int. Cl.
*A47L 7/00* (2006.01)

(52) U.S. Cl. ..... 15/320; 15/322; 15/319

(58) Field of Classification Search ..... 15/320, 15/322, 319; *A47L 7/00*
See application file for complete search history.

(56) References Cited

U.S. PATENT DOCUMENTS

| | | | | |
|---|---|---|---|---|
| 4,014,067 | A | 3/1977 | Bates et al. | 15/320 |
| 4,879,784 | A | 11/1989 | Shero | |
| 4,956,891 | A | 9/1990 | Wulff | 15/320 |
| 5,012,549 | A | 5/1991 | Williams et al. | |
| 5,077,862 | A | 1/1992 | Rench | |
| 5,189,757 | A | 3/1993 | Williams et al. | |
| 5,347,678 | A * | 9/1994 | Williams et al. | 15/331 |
| RE35,033 | E | 9/1995 | Waldhauser | |
| 5,455,982 | A | 10/1995 | Armstrong et al. | |
| 5,500,977 | A | 3/1996 | McAllise et al. | |
| 5,867,861 | A | 2/1999 | Kasen et al. | |
| 6,453,506 | B1 | 9/2002 | Summer | 15/322 |
| 6,533,871 | B2 | 3/2003 | Zahuranec et al. | |
| 6,560,817 | B2 | 5/2003 | Deiterman et al. | 15/320 |
| 7,392,566 | B2 | 7/2008 | Gordon et al. | |

* cited by examiner

*Primary Examiner*—David A Redding
(74) *Attorney, Agent, or Firm*—Michael Best & Friedrich LLP

(57) ABSTRACT

A cleaning machine for cleaning a surface is provided. The cleaning machine includes a base assembly that moves along the surface and a liquid distribution system associated with the base assembly for distributing the cleaning solution to the cleaning surface. A suction nozzle assembly is mounted to the base assembly and includes a front nozzle portion and a rear nozzle portion. The front nozzle portion defines a fluid flow path having an inlet opening and an outlet opening and the rear nozzle portion defines a fluid flow path having an inlet opening and an outlet opening. A suction source is in fluid communication with the suction nozzle for applying suction to draw the cleaning solution and dirt from the surface and through the suction nozzle assembly. The fluid flow path of the front nozzle portion is closed in response to the base assembly moving in one of the forward direction and rear direction. The fluid flow path of the rear nozzle portion is closed in response to the base assembly moving in other one of the forward and rear direction.

6 Claims, 14 Drawing Sheets

CLEANING MACHINE FOR CLEANING A SURFACE

RELATED APPLICATION DATA

This application is a divisional of U.S. patent application Ser. No. 10/698,149, filed on Oct. 30, 2003, now U.S. Pat. No. 7,392,566.

BACKGROUND OF THE INVENTION

1. Field of the Invention

The present invention relates to a cleaning machine for cleaning a surface.

2. Background Information

It is known to have cleaning machines for cleaning a surface. One example of a cleaning machine is a carpet extractor that distributes cleaning solution to a cleaning surface and substantially simultaneously extracts it along with the dirt on the carpet in a continuous operation as shown in U.S. Pat. No. 5,500,977. In several instances, the carpet extractor is pushed forward to clean one cleaning path and then moved sidewardly and pulled rearwardly to clean another cleaning path. However, usually the suction nozzle is positioned in front of the distribution of the cleaning solution. Thus, cleaning solution is left on cleaning paths in which the extractor was only pushed forward. To solve this problem, a dual suction nozzle assembly incorporating front and rear nozzle portions positioned on each side of the cleaning distribution means is provided on the carpet extractor. This structure allows the cleaning solution and dirt to be extracted from the surface on either the forward or rearward strokes. However, the added suction area from the additional nozzle portion results in a loss of suction power in each nozzle portion.

In addition, it would be desirable to distribute the cleaning solution at certain locations with respect to the cleaning elements of the carpet extractor for optimum cleaning of the surface during the forward and rearward strokes. For example, if the carpet extractor includes a brush roll, it would be desirable to dispense the cleaning solution on the front side of the brush roll during the front stroke, yet dispense the cleaning solution on the rear side of the brush roll during the rearward stroke so that the cleaning solution can be scrubbed into the cleaning surface by the brush roll on either stroke.

Hence, it is an object the present invention to provide a cleaning machine that cleans the cleaning surface well on both the forward and reverse strokes.

SUMMARY OF THE INVENTION

The foregoing and other objects of the present invention will be readily apparent from the following description and the attached drawings. In one aspect of the invention, a cleaning machine for cleaning a surface in which cleaning solution is distributed to the surface and substantially simultaneously extracted along with the dirt on the surface in a continuous operation as it moves along the surface is provided. The cleaning machine includes a base assembly that moves along the surface and a liquid distribution system associated with the base assembly for distributing the cleaning solution to the cleaning surface. A suction nozzle assembly is mounted to the base assembly and includes a front nozzle portion and a rear nozzle portion. The front nozzle portion defines a fluid flow path having an inlet opening and an outlet opening and the rear nozzle portion defines a fluid flow path having an inlet opening and an outlet opening. A suction source is in fluid communication with the suction nozzle for applying suction to draw the cleaning solution and dirt from the surface and through the suction nozzle. A valve assembly is associated with the suction nozzle assembly. The valve assembly substantially covers the outlet of the front nozzle portion to close the fluid flow path of the front nozzle portion in response to the base assembly moving in one of the forward direction and rear direction. The valve assembly substantially covers the outlet of the rear nozzle portion to close the fluid flow path of the rear nozzle portion in response to the base assembly moving in the other one of the forward direction and rear direction.

In another aspect of the invention, a cleaning machine for cleaning a surface in which cleaning solution is distributed to the surface and substantially simultaneously extracted along with the dirt on the surface in a continuous operation as it moves along the surface is provided. The cleaning machine includes a base assembly that moves along the surface and a liquid distribution system associated with the base assembly for distributing the cleaning solution to the cleaning surface. A suction nozzle assembly is mounted to the base assembly and includes a front nozzle portion and a rear nozzle portion. The front nozzle portion defines a fluid flow path having an inlet opening and an outlet opening and the rear nozzle portion defines a fluid flow path having an inlet opening and an outlet opening. A suction source is in fluid communication with the suction nozzle for applying suction to draw the cleaning solution and dirt from the surface and through the suction nozzle assembly. The liquid distribution system further includes at least one front distributor and one rear distributor.

In still another aspect of the invention, a cleaning machine for cleaning a surface in which cleaning solution is distributed to the surface and substantially simultaneously extracted along with the dirt on the surface in a continuous operation as it moves along the surface is provided. The cleaning machine includes a base assembly that moves along the surface and a liquid distribution system associated with the base assembly for distributing the cleaning solution to the cleaning surface. A suction nozzle assembly is mounted to the base assembly. A suction source is in fluid communication with the suction nozzle for applying suction to draw the cleaning solution and dirt from the surface and through the suction nozzle assembly. The liquid distribution system further includes at least one front distributor and one rear distributor. One of the front distributor and the rear distributor dispensing the cleaning solution in response to the base assembly moving in a first direction and other one of the front distributor and the rear distributor dispensing the cleaning solution in response to the base assembly.

BRIEF DESCRIPTION OF THE DRAWINGS

The invention will now be described, by way of example, with reference to the attached drawings, of which.

DETAILED DESCRIPTION OF THE INVENTION

Figure 1:
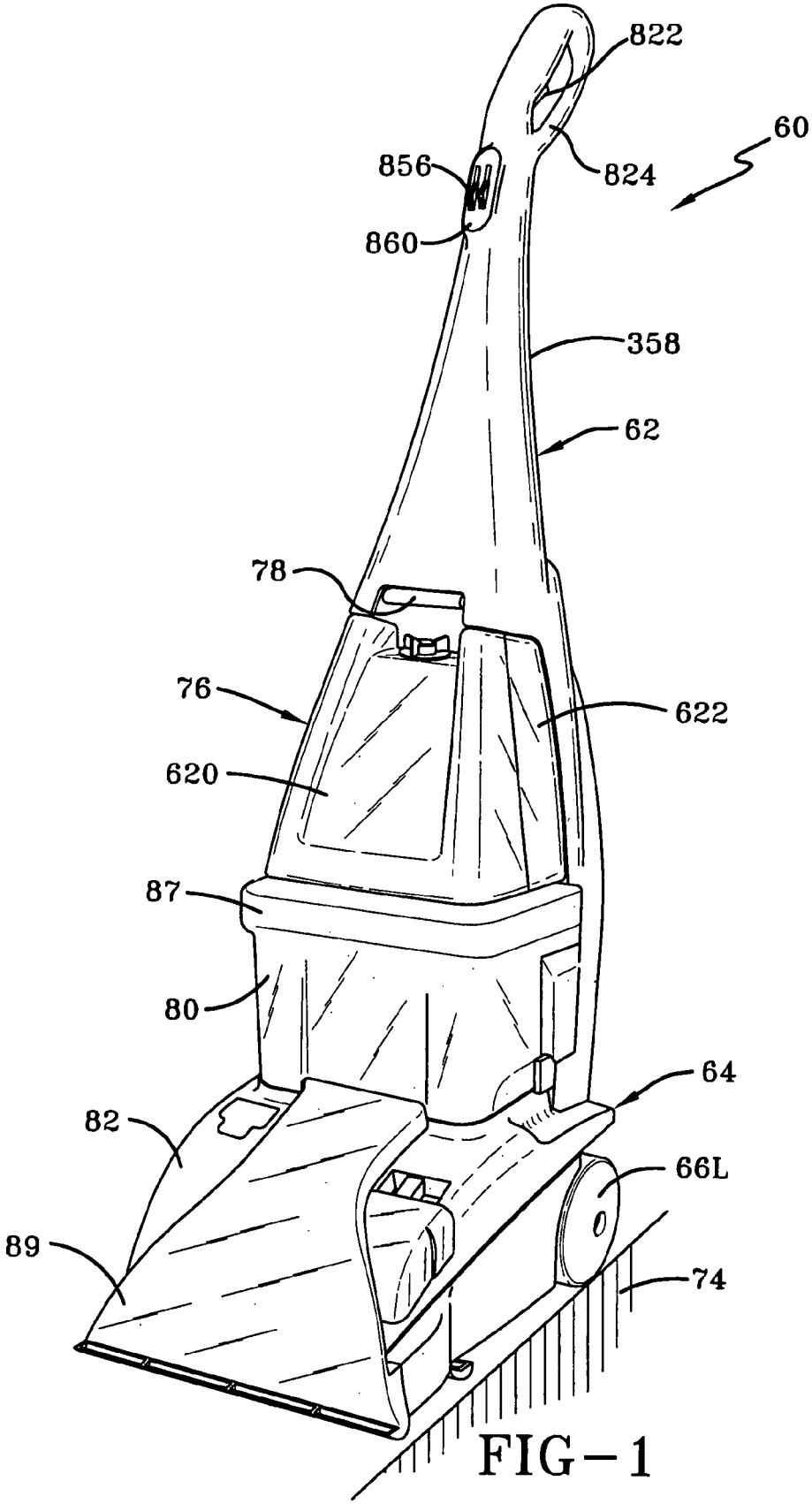
FIG. 1 is a perspective view of a carpet extractor embodying the present invention.

Referring to the drawings, FIG. 1 depicts a perspective view of an upright carpet extractor 60 according to one embodiment of the present invention. The upright carpet extractor 60 comprises an upright handle assembly 62 pivotally connected to the rear portion of the floor-engaging portion or base assembly 64 that moves and cleans along a surface 74 such as a carpet or bare floor. The base assembly 64 includes two laterally displaced wheels 66L and 66R (FIG. 4) rotatably attached thereto. A transmission assembly 67 (FIG. 4) is mounted to the base assembly 64 and operatively connected to the wheels so that the extractor 60 can be self-propelled.

Figure 4:
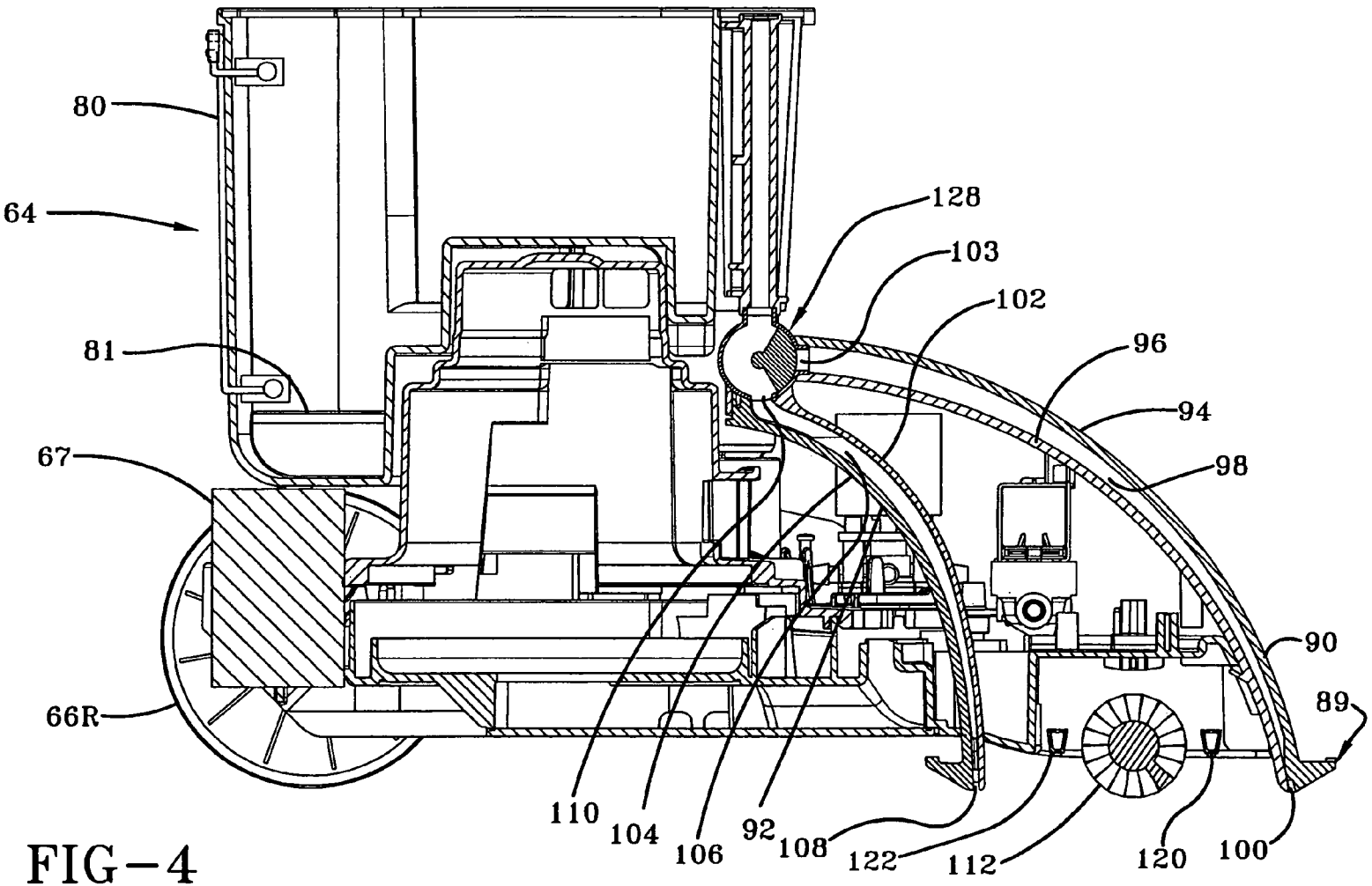
FIG. 4 is a sectional view taken along line 4-4 of FIG. 3.

A supply or solution tank assembly 76 is removably mounted to the handle portion 62 of the extractor 60. A combined air/water separator and recovery tank 80 with carrying handle 87 removably sets atop a suction motor/fan assembly 81 (FIG. 4) of the base assembly 64 and is surrounded by a hood portion 82. A floor suction nozzle assembly 89 is mounted to the hood portion 82 of the base assembly 64 and is in fluid communication with the recovery tank 80 for transporting air and liquid into the recovery tank 80. The floor suction nozzle assembly 89 includes a front nozzle portion 90 and a rear nozzle portion 92 as shown in FIG. 4. The front nozzle portion 90 includes a front plate 94 secured to a rear plate 96 that in combination define a duct 98 that slopes forwardly down to the front portion of the base assembly 64. The front nozzle portion 90 further has an inlet 100 located at the lower end of the duct 98 and an outlet 103 located at the upper end of the duct 98. The rear nozzle portion 92 includes a front plate 102 secured to a rear plate 104 that in combination define a duct 106 that slopes forwardly down the base assembly 64. The rear nozzle portion 90 further has an inlet 108 located at the lower end of the duct 106 and an outlet 110 located at the upper end of the duct 106. Both inlets extend across the base assembly 64.

Figure 3:
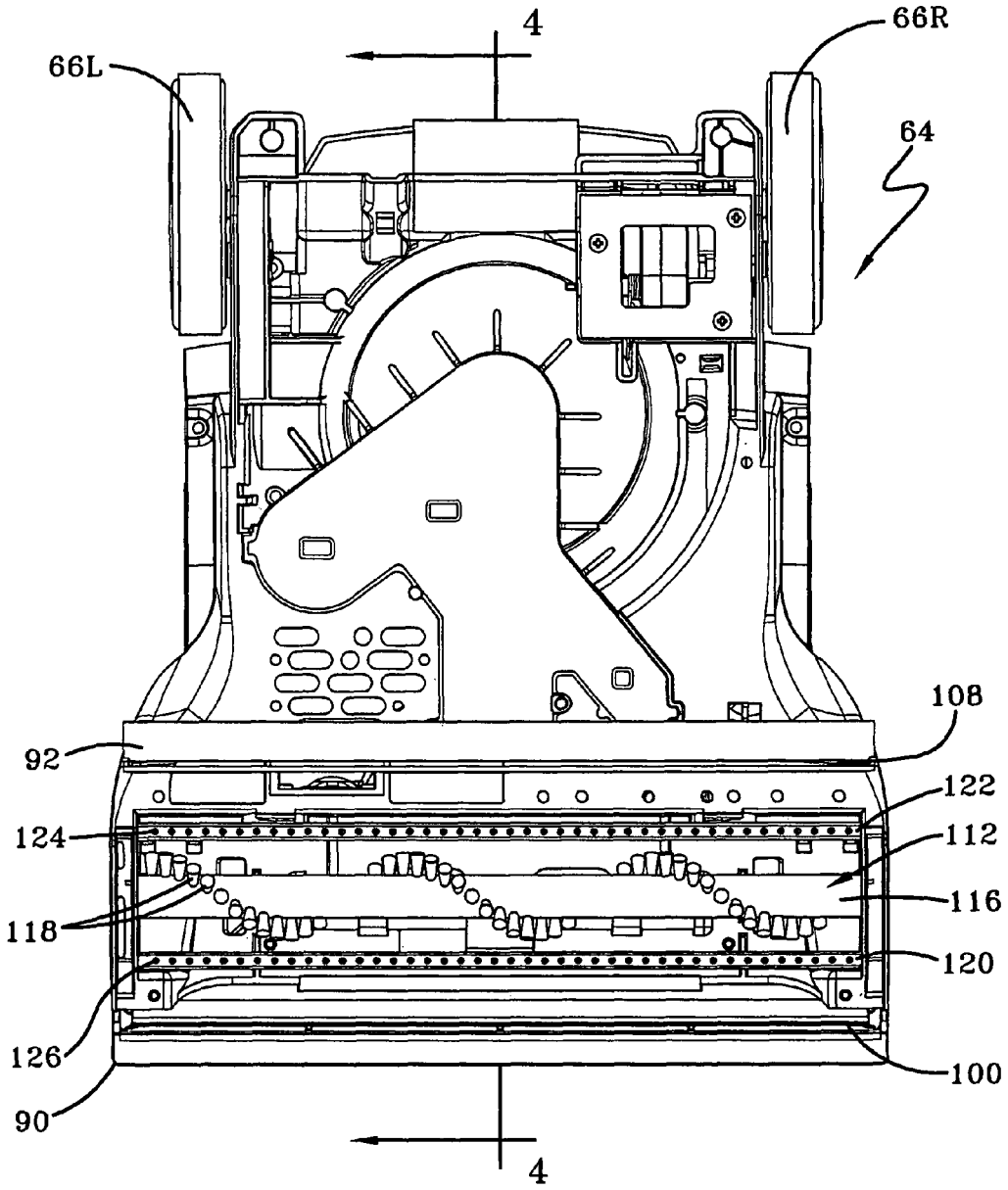
FIG. 3 is a bottom plan view of the base assembly of the carpet extractor of FIG. 1.

As depicted in FIG. 3, a brush assembly 112 in the form of a horizontal brushroll is rotatingly connected to the base assembly 64 intermediate the front nozzle portion 90 and rear nozzle portion 92. The brush assembly 112 includes a cylindrical drum 116 and at least a row of bristle bundles 118 secured to the drum 116 extending radially therefrom. The bristle bundles 118 are secured to the drum 116 in a generally helical pattern originating at each end of the drum 116 and terminating at the center of the drum 116. The brush assembly 112 is driven by the suction motor 81 via a belt (not shown) or any additional suitable motor. Other brush assemblies could be also used such as, for example, a vertical axis brush or a vibrating or oscillating type brush assembly.

The brush assembly 112 is also positioned between a front spray bar 120 and a rear spray bar 122. The spray bars 120, 122 are mounted to the base assembly 64 and positioned between the front and rear nozzle portions 90, 92. Each spray bar extends across the width of the base assembly and includes a row of openings 124, 126 for spraying cleaning solution on the surface. The front and rear spray bars 120, 122 distributed either clean water or detergent mixed with clean water depending on the direction of the extractor 60 moving along the surface 74 which will be described in detail later.

Referring back to FIG. 1, the supply tank assembly 76 comprises a clean water supply tank 620 with cap 635 and a detergent supply tank 622 with cap 720 adhesively mounted to the clean water supply tank 620. The supply tank assembly 76 includes a combination carrying handle and tank securement latch 78 providing a convenient means for carrying the tank and/or securing the tank to the extractor handle assembly 62.

Figure 5:
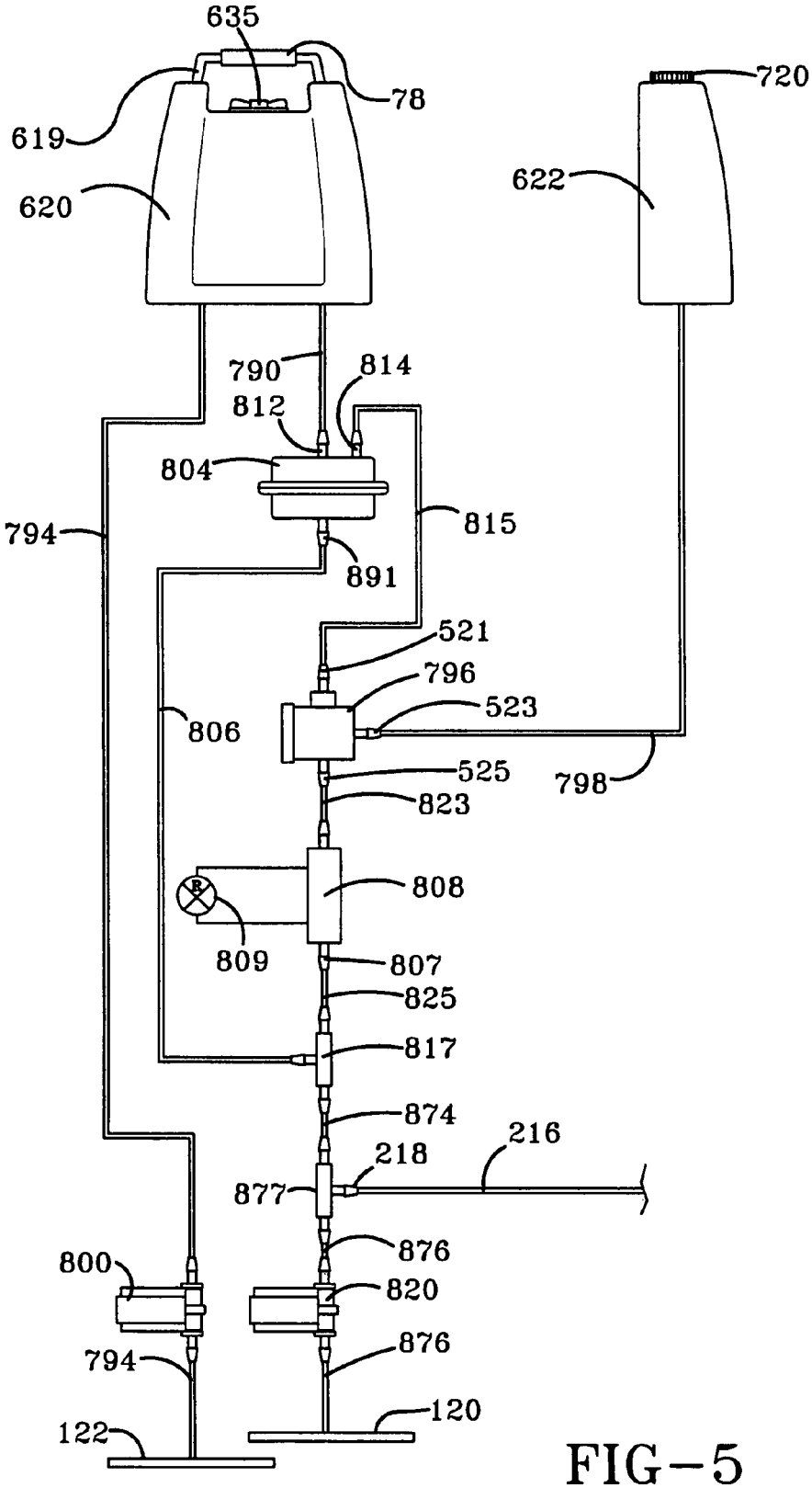
FIG. 5 is a schematic view of the fluid distribution system of the carpet extractor of FIG. 1.

With reference to FIG. 5, the carpet extractor 60 includes a solution hose 794 that fluidly connects the outlet of the clean water tank 620 to a shut off valve 800 used for selectively turning on and off the flow of clean water to the rear spray bar 122, which is fluidly connected to the clean water tank 620 via solution hose 794 downstream of the valve 800. Another solution hose 790 fluidly connects the outlet of the water tank 620 to an inlet 812 of a pressure actuated shut off valve 804. The outlet of the detergent tank 622 is fluidly connected to the inlet 523 of a mixing chamber 796 via a suitable flexible hose 798.

The pressure actuated shut off valve 804 is fluidly connected between the clean water tank 620 and the mixing valve 796 for turning off and on the flow of water. This shut off valve 804 is opened and closed by outside pressure via a conduit 806 connected between it and the outlet 807 of a pump 808 through a Tee 817. The valve 804 includes a pressure port 891 fluidly connected to the outlet 807 of a pump 808. The outlet of the valve 814 is fluidly connected to the inlet 521 of the mixing valve 796 via hose 815. It should be known that clean water tank 620 could be fluidly connect to the outlet 814 of the valve 804 with the inlet 812 of the valve 804 being fluidly connect to the mixing valve 796 so that fluid could flow the opposite direction if desired.

In operation, when the pressure at the pressure port 891 is below a predetermined value such as between 7 to 10 psi, the valve 804 opens to allow water to flow in both directions. Such a pressure value at the pressure port 891 occurs when the main shut off valve 820 is opened and the pump 808 is turned on. The pump 808 also pressurizes the water mixed with detergent to draw it to the front spray bar 120. When the pressure exceeds a second predetermined value such as between 20 to 30 psi, the valve 804 closes. This would occur if the main shut off valve 820 is closed and the pump is turned on. Thus, with the valve 804 closed, clean water or detergent is prevented from flowing through it. Various types of pumps can be used such as a gear pump or centrifugal pump.

The outlet 525 of the mixing Tee 796 is fluidly connected via flexible hose 823 to the inlet of the pump 808, which provides pressure to draw the cleaning solution to the front spray bar 120, when it is turned on. A relief valve 809 is fluidly connected across the pump 808 to limit the pressure at the outlet 807 of the pump 808 to a predetermine value. The outlet 807 of the pump 808 is fluidly connected to the main shut off valve 820 via flexible hoses 825, 874 and 876. Both of the shut off valves 800, 820 are in the form of a solenoid valve, however, other electrical actuated valves could be also used.

The valves 800, 820 are operated by a trigger switch 821 as depicted in FIG. 1. The trigger switch 821 is pivotally connected to the upper handle portion 358 approximately near a closed looped handgrip 824. Slide switch 858 is used to select one of the shut off valve 800, 820 to be opened and closed by the trigger switch 821. Slide switch 856 is the main power switch, which turns on and off the suction motor 81, pump 808, and brush motor 73. Alternatively, a separate switch could be incorporated to turn on and off the brush motor independent of the main power switch. The water or detergent mixed with water cleaning solution from the tanks 620, 622 flows to their associated shut off valves 800, 820 and spray bars. A solution discharge valve 877 allows mixed detergent and clean water to flow through an integrally formed nipple 218 and a detachable solution tube 216 to a hand-held cleaning attachment (not shown) and dispense by typical spray means.

Figure 6:
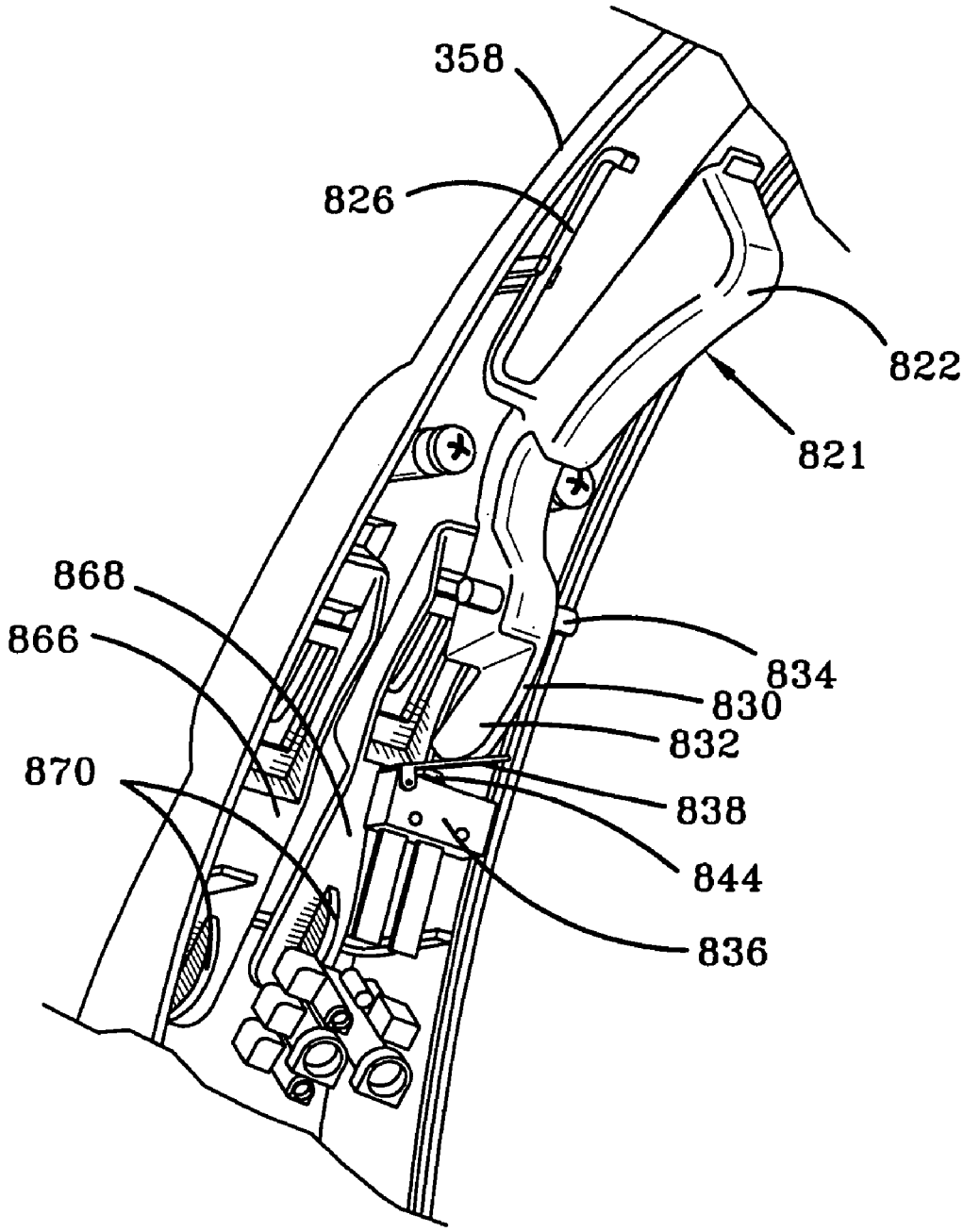
FIG. 6 is a fragmentary rear perspective view of an upper portion of the handle of FIG. 1 with portions cut away to show elements of the trigger switch and actuating rods for the cleaning mode switch assembly.
Figure 7:
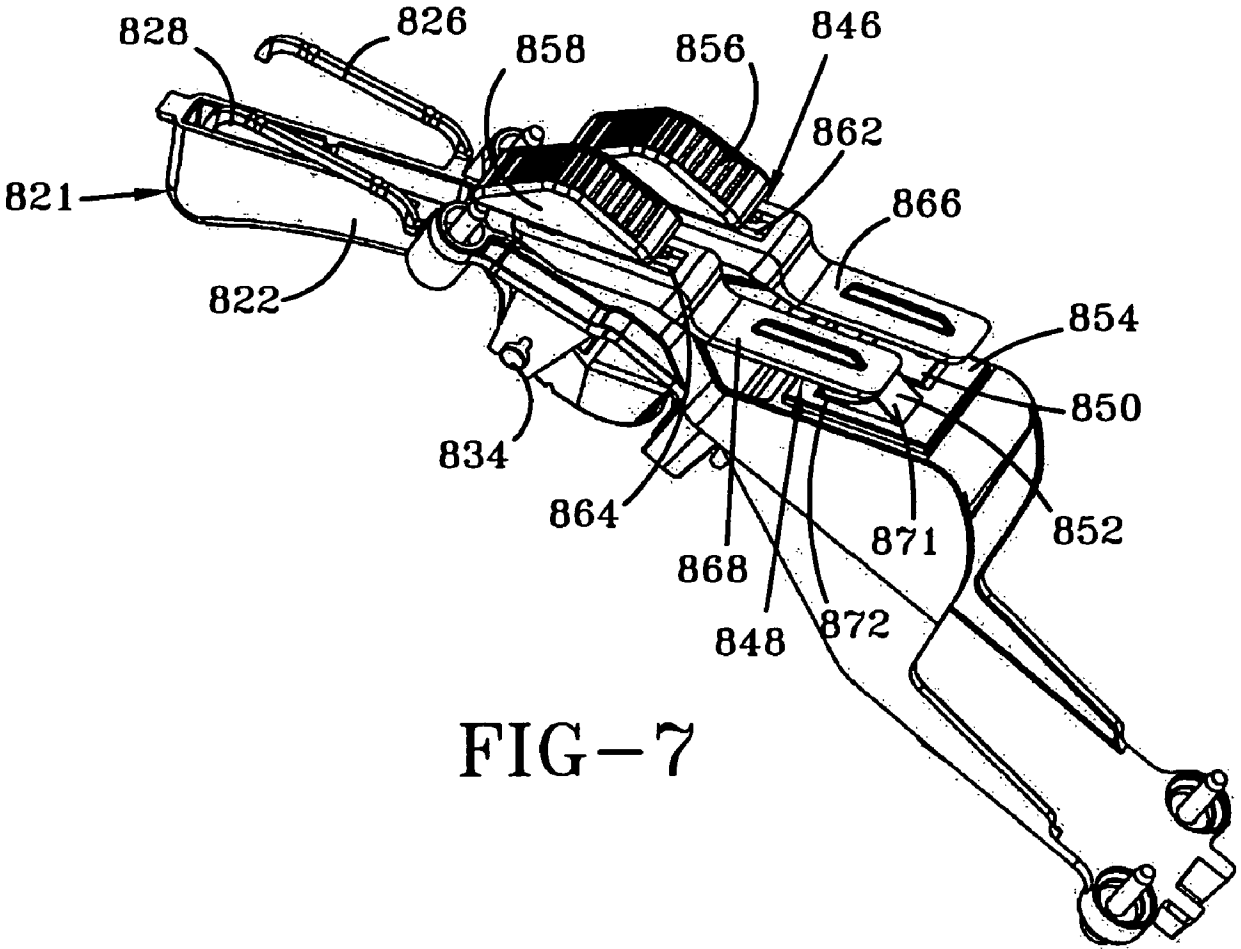
FIG. 7 is a fragmentary front rear perspective view of an upper portion of the handle of FIG. 1 with portions cut away to show the cleaning mode switch assembly and related parts.

Referring to FIGS. 6 and 7, a trigger switch 821 is used to dispense either mixed detergent and clean water or only clean water. The trigger switch 821 includes a trigger 822 pivotally connected to the upper handle portion 358 approximately near a closed looped handgrip 824 (FIG. 1) of the upper handle portion 358 at a pivot 834. Integrally molded onto the trigger 822 are two cantilever springs 826, 828 (FIG. 7), one on each lateral side thereof. The cantilever springs 826, 828 urge the trigger 822 outwardly or downwardly which places one of the selected shut off valves 800, 820 (FIG. 5) in the closed position. In particular as depicted in FIG. 6, an arm 830 having a curved end portion 832 extends downwardly from the pivot 834 of the trigger 822 terminating adjacent a microswitch 836 of the trigger switch 821. A lever arm 838 is connected to the microswitch 836 and extends over a spring-loaded push button 844 on the microswitch 836. When the upper portion of the trigger 822 is positioned downwardly, the curved end portion 832 is spaced from the lever arm 838.

Figure 8:
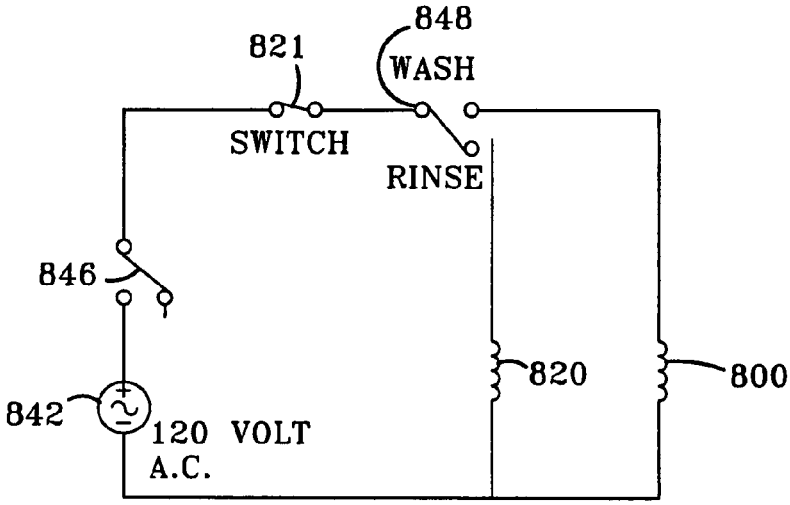
FIG. 8 is a schematic diagram showing the electrical circuit for the fluid distribution system used in the embodiment shown in FIG. 1.

In this position with reference to FIG. 8, the microswitch 836 opens the circuit between one of the solenoid shut off valves 800, 820 and the main power source 842, thereby denergizing the selected valve 800 or 820 and closing it. When the upper portion of the trigger 822 is squeezed or depressed, the curved end portion 832 cams against the lever arm 838 such that the lever arm 838 depresses the push button 844 on the microswitch 836. Upon depression of the push button 844, the microswitch 836 closes the circuit as depicted in FIG. 8 between one of the solenoid shut off valves 800, 820 and the main power switch assembly 846. If the main power switch assembly 846 is switched on to connect the power source 842 to the selected solenoid shut off valve 800 or 820 and the trigger 822 is squeeze or depressed, the selected solenoid shut off valve energizes and opens.

A cleaning mode switch assembly 848 is connected between the microswitch 836 and the water and main solenoid shut off valves 800, 820 to select the mode of cleaning. As shown in FIG. 7, the cleaning mode switch assembly 848 and main power switch assembly 846 include respective rocker arms 850, 852 positioned adjacent each other and mounted in a module 854 which is mounted in the upper handle portion 358. The rocker arms 850, 852 are actuated by corresponding slide switches 856, 858 which are received in a recess 860 (FIG. 1) just below the handgrip 824. The slide switches 856, 858 snap connect into corresponding slots 862, 864 formed on the upper portions of respective actuating rods 866, 868. Cam portions 870 (FIG. 6) are formed on lower portions of the actuating rods 866, 868 for engaging their corresponding rocker arms 850, 852. When one of the slide switches 856, 858 is slid downwardly, the cam portion 870 depresses the lower portion 871 of the rocker arm 850 or 852 to switch it in one position. This action also raises the upper portion 872 of the rocker arm 850 or 852. Then, when the slide switch 856 or 858 is then slid upwardly back, the cam portion 870 depresses the upper portion of the rocker arm 850 or 852 to switch it in another position and thereby raise the lower portion 871 of the rocker arm 850 or 852. It should be noted that the locations of cleaning mode switch assembly 848 and main power switch assembly 846 in the recess 860 can be switched. In other words viewed from FIG. 7, the cleaning mode switch assembly 848 can be located on right portion of the recess 860 instead of the left portion and the main power switch assembly 846 can be located on the left portion of the recess 860 instead of the right portion.

In operation, a user slides the slide switch 856 of the main power switch assembly 846 down to electrically connect the power source 842 to the microswitch 836, suction motor 90, and pump 808, turning them on. Referring to FIG. 5, the pump 808 conducts the pressurized cleaning solution through a main supply tube 874 to a control valve 877 which selectively allows the liquid to flow to either the front spray bar 120 via supply tube 876 or the hand-held cleaning attachment (not shown) via a supply tube 216. The front spray bar 120 evenly distributes the cleaning liquid in front of the brush assembly 112. The brush assembly 112 then spreads the cleaning liquid onto the carpet (or bare floor), scrubs the cleaning liquid into the carpet, and dislodges embedded soil.

Referring to FIG. 1, as is commonly known, the carpet extractor 60 distributes cleaning solution to the carpeted surface and substantially simultaneously extracts it along with the dirt on the carpet in a continuous operation. In particular, soiled cleaning liquid is extracted from the carpet by the suction nozzle assembly 89, which communicates with the recovery tank 80. A vacuum is created in the recovery tank 80 by the motor fan assembly 90 (FIG. 3) that draws air from the recovery tank 80 and exhausts the air to the carpeted surface as previously described.

If the wash cleaning mode is desired, the user slides the slide switch 858 of the cleaning mode switch assembly 848 upwardly to the upper end of the recess 860 to electrically connect the microswitch 836 (FIG. 6) to the main solenoid shut off valve 820 (FIG. 8). Then, the user squeezes the trigger 822 (FIG. 1), which opens the main solenoid, shut off valve 820 to allow the cleaning solution composed of detergent mixed with clean water to flow to the front spray bar 120, where it is distributed and scrubbed on the carpet by the brush assembly 112. If rinsing is desired, the user slides the slide switch 858 of the cleaning mode switch assembly 848 downwardly to the lower end of the recess 860 to electrically connect the microswitch 836 to the water solenoid shut off valve 800. Then, the user squeezes the trigger 822, which opens the water solenoid shut off valve 800 to allow clean water from the clean water tank 620 to flow to the rear spray bar 122, where it is distributed and scrubbed into the carpet by the brush assembly 112.

Figure 8A:
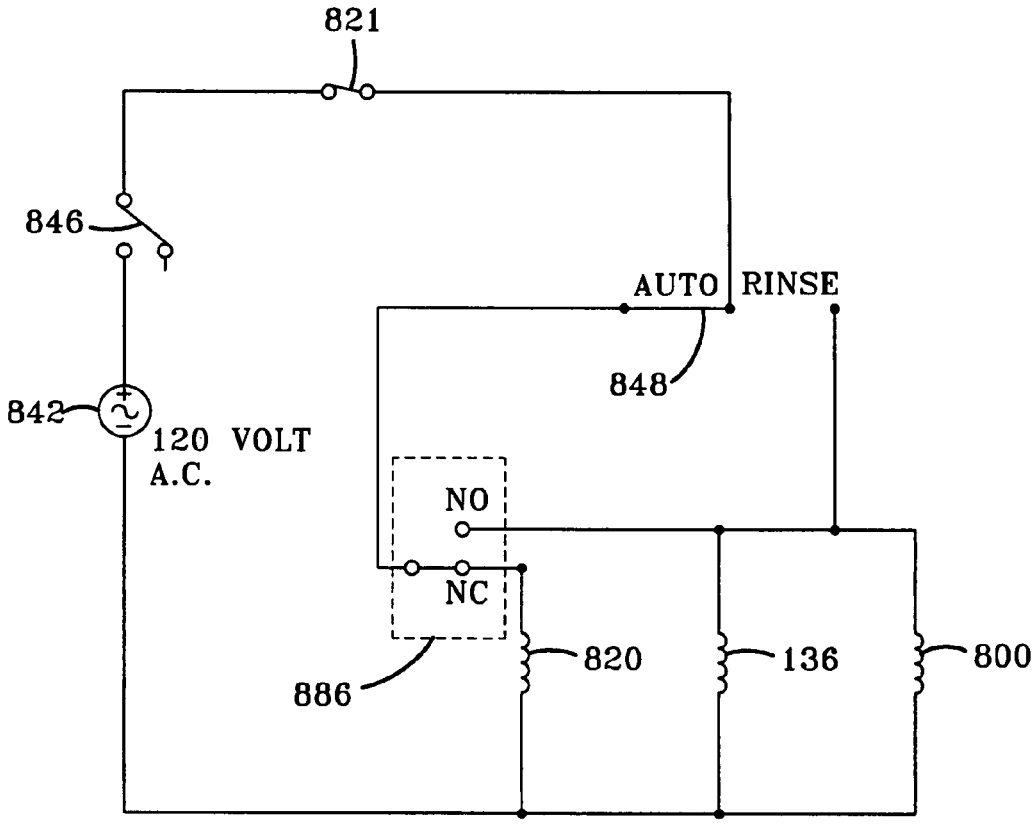
FIG. 8A is a schematic diagram showing another electrical circuit for the fluid distribution system used in the embodiment of FIG. 1 that automatically cleans the carpet or floor using one cleaning mode on the forward stroke of a cleaning cycle and another cleaning mode for the reverse stroke of the cleaning cycle.

FIG. 8A depicts an electrical schematic diagram of the distribution system of the carpet extractor 60 that automatically cleans the carpet or floor using one cleaning mode on the forward stroke of a cleaning cycle and another cleaning mode for the reverse stroke of the cleaning cycle. Components from the circuit shown in FIG. 8, which are identical in structure and have identical functions will be identified by the same reference numbers for this circuit. To place the carpet extractor in this mode of operation, the user slides the slide switch 858 of the cleaning mode switch assembly 848 upwardly to the upper end of the recess 860 to electrically connect the microswitch 836 to the main solenoid shut off valve 820. In this circuit, a second microswitch 886 is connected between the water and main solenoid shut off valves 800, 820.

Figure 2:
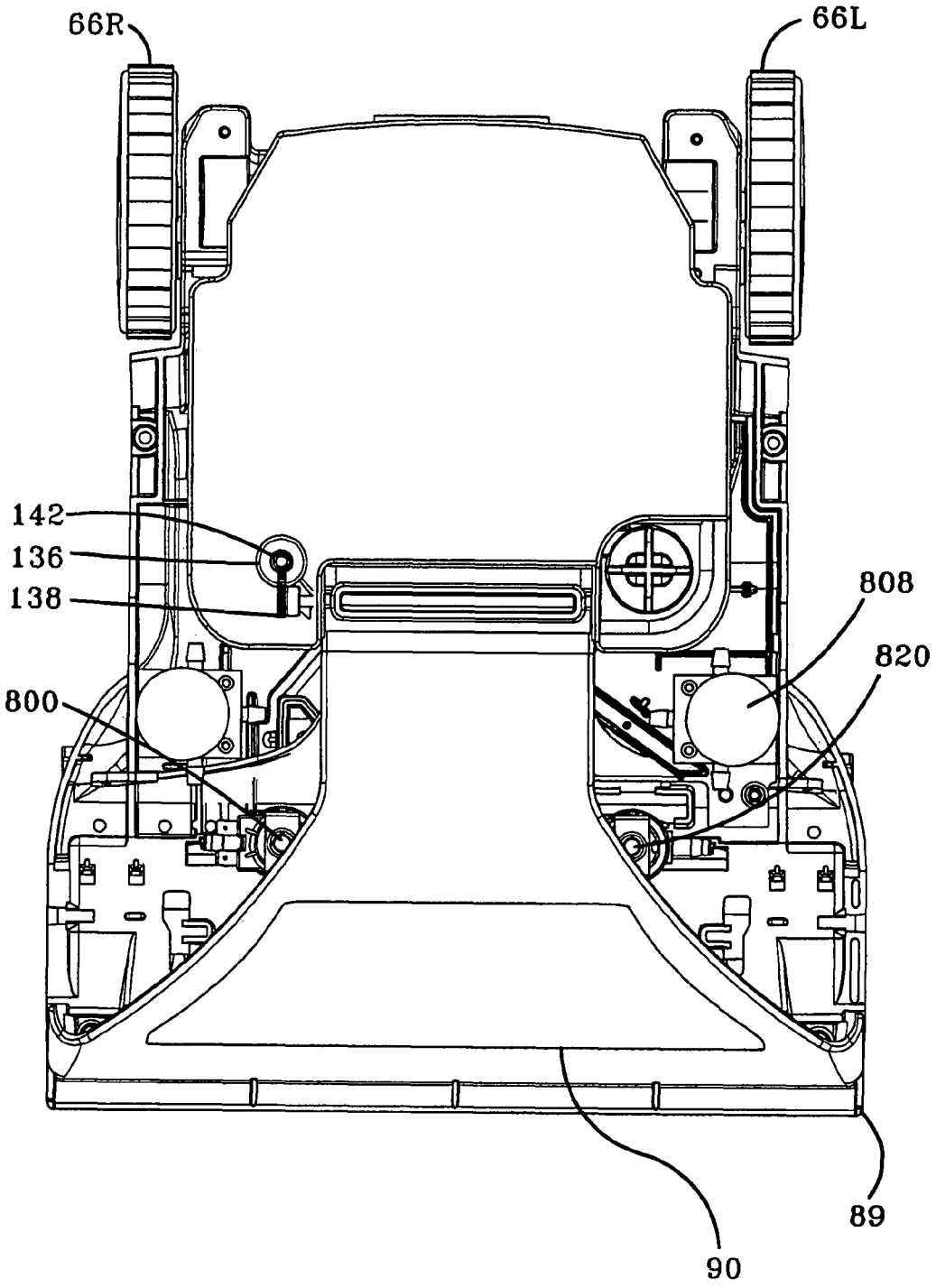
FIG. 2 is a top plan view of the base assembly of the carpet extractor of FIG. 1 with portions removed for illustration.
Figure 9:
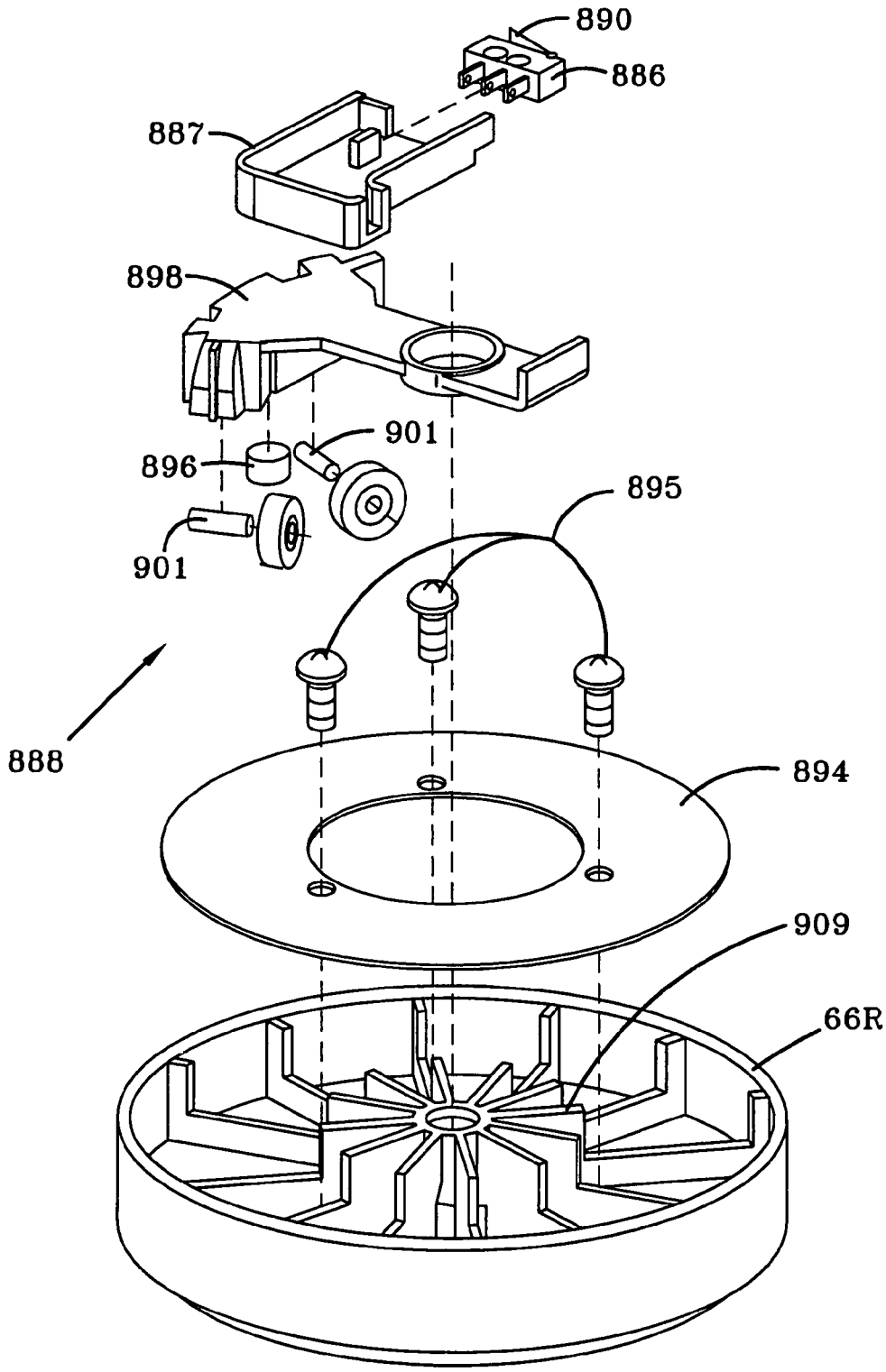
FIG. 9 is an exploded view of the wheel rotation activating assembly and right rear wheel of the embodiment shown in FIG. 1, which uses the electrical circuit of FIG. 8A.
Figure 10A:
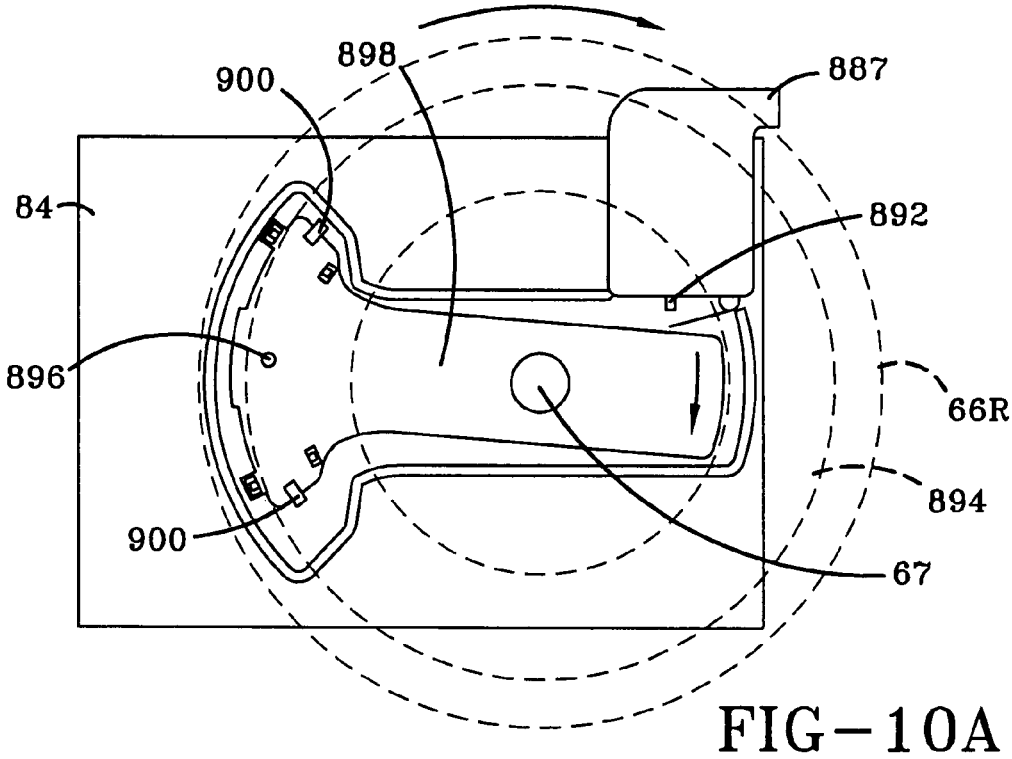
FIG. 10A is a partial right side view of the base of the carpet extractor of FIG. 1 showing the wheel rotation activating assembly of FIG. 9 operating to wash the carpet or floor during the forward stroke.
Figure 10B:
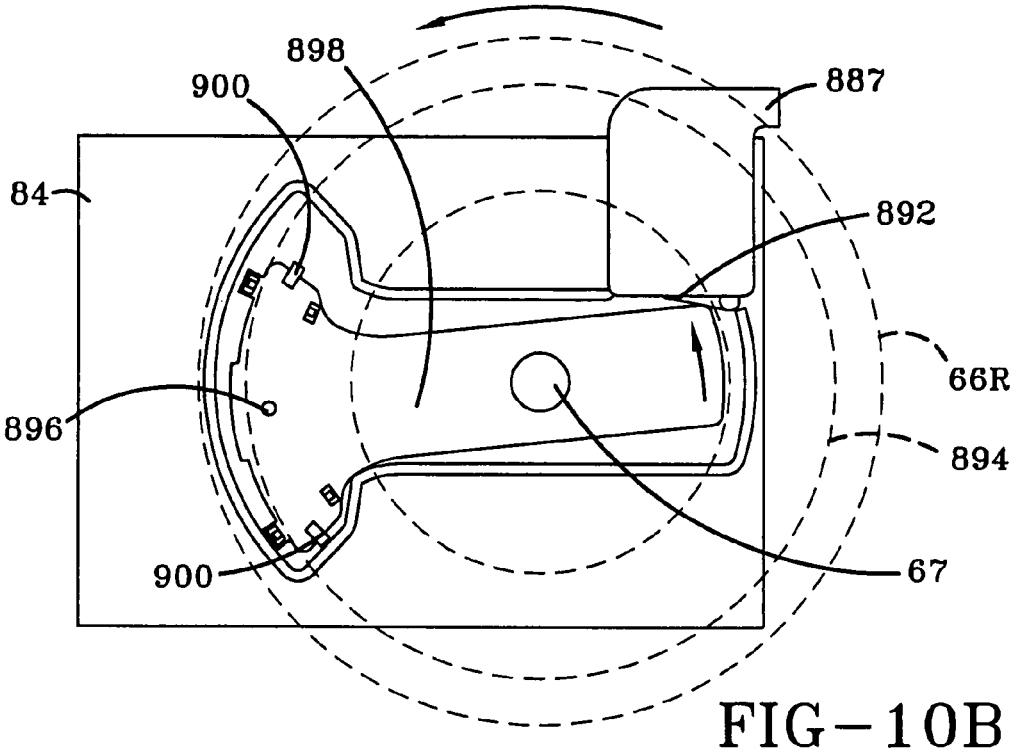
FIG. 10B is a view similar to FIG. 10A but with the wheel rotation activating assembly being operated to rinse the carpet or floor during the reverse stroke.

As depicted in FIG. 9, the microswitch 886 is part of a wheel rotation activating assembly 888 associated with the right rear wheel 66R on the right side of the foot portion base assembly 64 (FIG. 2). A lever arm 890 is connected to the microswitch 886 and extends over a spring-loaded push button 892 (FIGS. 36A and 36B) on the microswitch 886. A microswitch cover 887 covers the microswitch 886 and this assembly is mounted to the body 84 of the base assembly 64. The wheel rotation activating assembly 888 further includes a magnet 896 secured to an actuation lever 898 positioned spacedly adjacent a steel wheel disc 894 mounted to the rear extractor wheel 66R by screws 895. As depicted in FIGS. 10A and 10B, rollers 900, having axles 901 (FIG. 9) extending therethrough, are rotatably mounted to the actuation lever 898. The rollers 900 ride on the wheel disc 894 to ensure clearance between the magnet 896 and wheel disc 896. The axle 67 of the rear extractor wheel 66R slidably extends through the actuation lever 898 such that the actuation lever 898 is allowed to pivot or rotate around it. The actuation lever 898 is further positioned in a recess of the rear body 84 adjacent the microswitch 886. The magnets 896 follow the direction of rotation of the wheel 66R due to the magnetic attraction between them, thereby causing the actuation lever 898 to rotate.

Figure 12:
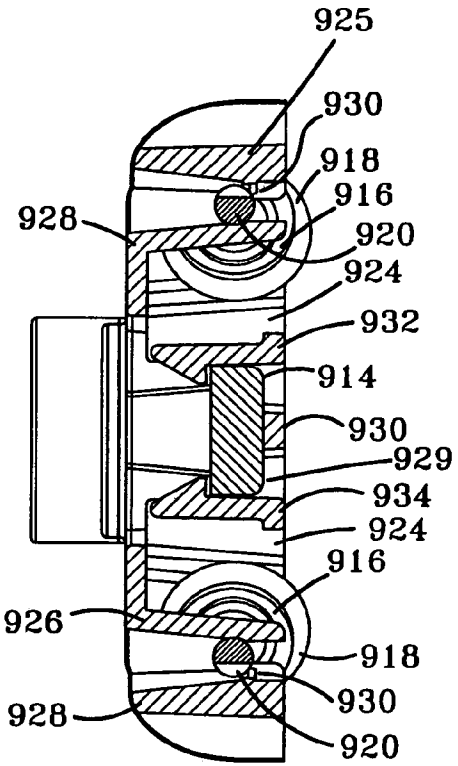
FIG. 12 is a sectional view taken along line 12-12 of FIG. 11.
Figure 11:
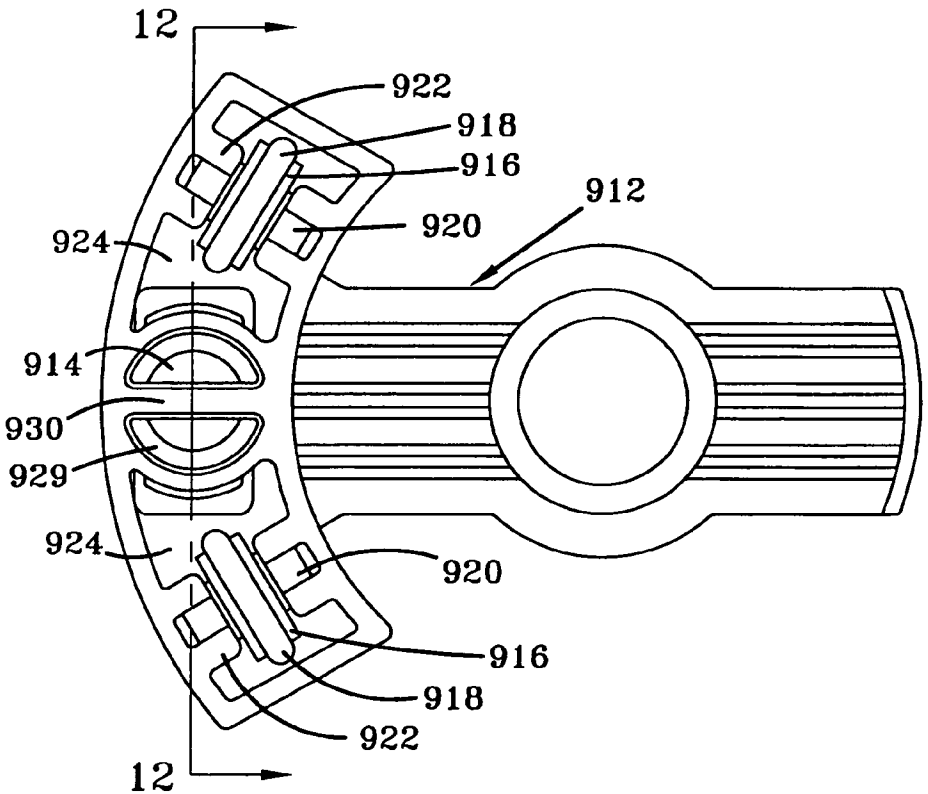
FIG. 11 is a side elevational view of another actuator lever and related parts used on the wheel rotation activating assembly of FIG. 9.

Alternatively, FIGS. 11 and 12 depict another actuation lever 912 with accompanying magnet 914 and rollers 916. These rollers 900 include rubber tires 918 secured around them and axles 920 extending through the center. The rollers 916 with the tires 918 are rotatably positioned in recesses 924 formed in the side 926 of the actuator lever 912 opposing the wheel disc 894. The axles 920 are snap connected into unshaped holders 922 formed in the side of the actuator lever 912 opposing the wheel disc 894.

In particular with reference to FIG. 12, the axles 920 are slidably inserted between elastic legs 926, 928 of the holder 922, engaging a pair of opposing ledges or barbs 930 formed on the legs 926, 928 which cause the legs 926, 928 to deflect outwardly to allow the holder to pass through. After the holder is inserted beyond the barbs, the legs retract back so that the barbs secure the axles within the holder. The magnet 914 is seated into an opening 929 of the actuation lever 898 and held securely in place by elastic catches 932, 934 engaging it against a rib 930 extending across the center of the opening 929. Other wheel rotation activating assemblies can be used such as those disclosed in co-pending application having Ser. No. 10/165,731; the disclosure being incorporated herein by reference.

When the carpet extractor unit 60 (FIG. 1) goes forward as indicated by the rotation of the rear wheel 66R in FIG. 10A, the actuation lever 898 and lever arm 890 are disengaged from the push button 892 of the microswitch 886. In this position, the microswitch 886 electrically connects the power source 842 to the main solenoid shut off valve 820, depicted in FIG. 8A. Thus, when the trigger 822 is squeezed, the main solenoid shut off valve 820 energizes and opens, thereby allowing water mixed with detergent to be supplied to the front spray bar 120 for distribution on the floor surface or hand-held cleaning attachment (if selected). When the extractor unit 60 moves rearward as indicated by the rotation of the rear wheel 66R in FIG. 10B, the actuation lever 898 engages the lever arm 890, which depresses the push button 892. This causes the microswitch 886 to electrically connect the power source 842 to the water solenoid shut off valve 800 as shown in FIG. 8A. Also, in this position, the microswitch 886 disconnects the power source 842 to main solenoid shut off valve 820, thereby deenergizing it. Thus, when the trigger 822 is squeezed, the water solenoid shut off valve 800 energizes and opens, thereby allowing clean water to be supplied to the rear spray bar 122 for distribution on the floor surface.

If rinsing is desirable on both the forward and reverse strokes, the user slides the slide switch 858 of the cleaning mode switch assembly 848 downwardly to the lower end of the recess 860 to electrically connect the microswitch 886 to the water solenoid shut off valve 800. Then, the user squeezes the trigger 822, which opens the water solenoid shut off valve 800 to allow clean water from the clean water tank 620 to flow to the rear spray bar 122 where it is distributed on the floor surface. Alternatively, if washing is desired on both the forward and reverse strokes, a three position cleaning mode switch assembly could be used instead of the two position cleaning mode switch assembly with the third position being directly connected to the main solenoid shut off valve 820 bypassing the second microswitch 886 of the wheel rotating activating assembly 888.

Figure 13A:
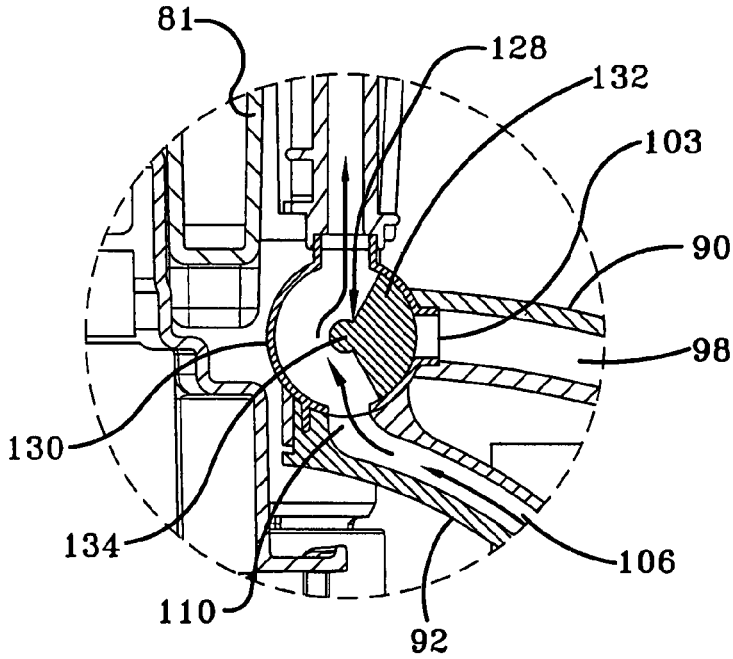
FIG. 13A is an enlarge view of the section of the base assembly circled in FIG. 4.
Figure 13B:
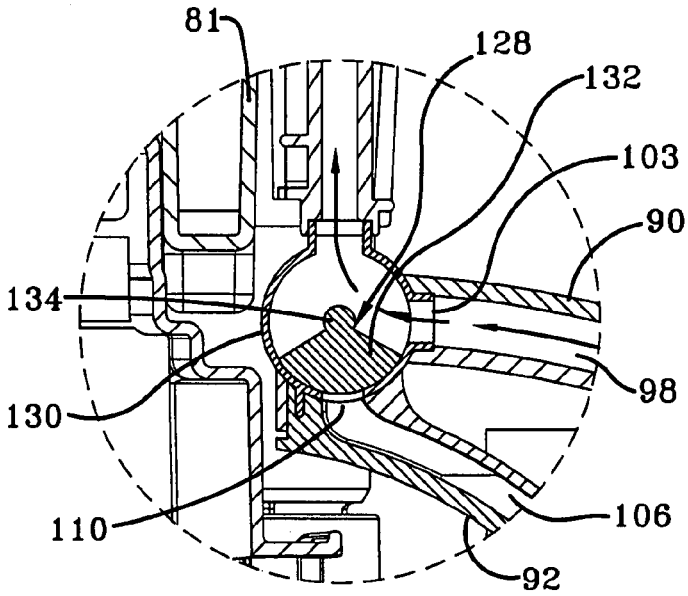
FIG. 13B is a view similar to FIG. 13A except that the valve is in a position that closes the rear nozzle portion and opens the front nozzle portion.

The amount of suction from the front and rear nozzle portions 90, 92 is controlled by a suction valve assembly 128 (FIG. 4). As best seen in FIGS. 13A and 13B, the outlets 103, 110 of the respective front and rear nozzle portions 90, 92 are in fluid communication with a cylindrically shaped valve body 130. An elongated valve part 132 is positioned within the valve body 130 and rotatably connected to the valve body 130 such that the valve part 132 pivots along its longitudinal axis. The valve part 132 is composed of a rubber material and generally has an arcuate shaped cross section with a cylindrical pivot center defining a shaft 134.

Figure 14:
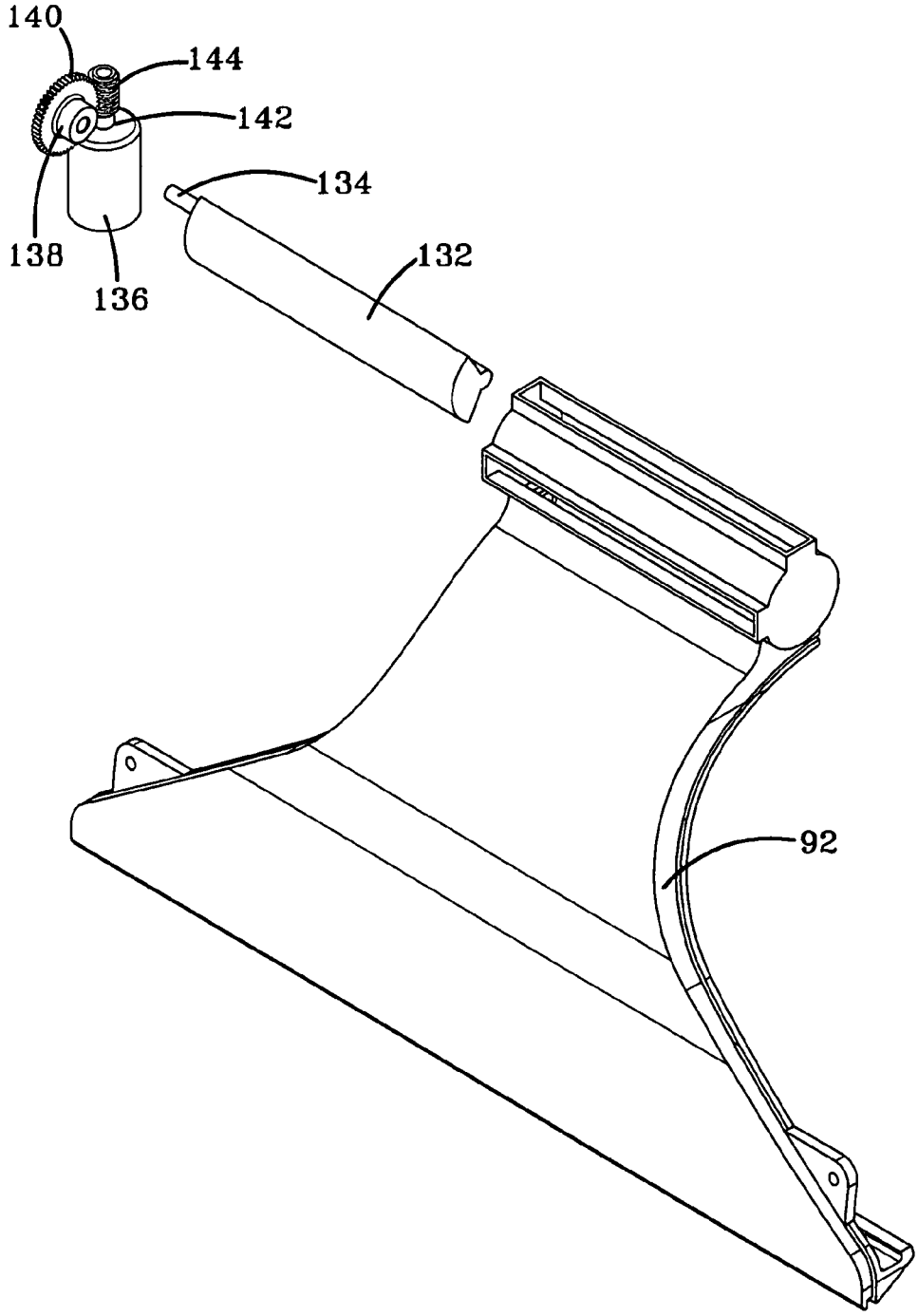
FIG. 14 is an exploded view of the valve assembly and rear nozzle portion of the carpet extractor of FIG. 1.

As seen in FIGS. 2 and 14, the valve part is driven by a solenoid 136. In particular, a gear 138 is attached at the right end of the shaft 134 and includes teeth 140, which mesh with grooves 144 of a worm gear 142 rotatably connected to the solenoid 136. As seen in FIG. 8A, the solenoid is coupled between the microswitch 886 and power source 842.

When the carpet extractor unit 60 (FIG. 1) goes forward as indicated by the rotation of the rear wheel 66R in FIG. 10A, the actuation lever 898 and lever arm 890 are disengaged from the push button 892 of the microswitch 886. In this position, the microswitch 886 is not electrically connected to the power source 842. Thus, as shown in FIG. 13A, the solenoid 136 is denergized, since power is not supplied to the solenoid 136 and the valve part 132 covers or blocks the outlet 103 of the front nozzle portion 90 but does not cover or block the outlet 110 of the rear nozzle portion 92. Thus, suction is created in the rear nozzle portion 92, when the suction motor 81 is operating, and the fluid flow path is opened to allow cleaning solution, dirt and air to flow through the duct 106 of the rear nozzle portion 92 and then to the recovery tank 81. By contrast, suction is not created in the front nozzle portion 90 and the fluid flow path for the front nozzle portion 90 is closed, so that cleaning solution, dirt, and air do not flow through the duct 98 and outlet 103.

When the extractor unit 60 moves rearward as indicated by the rotation of the rear wheel 66R in FIG. 10B, the actuation lever 898 engages the lever arm 890, which depresses the push button 892. This causes the microswitch 886 to electrically connect the power source 842 to the solenoid 136, which energizes it to rotate the worm gear 142 about a quarter turn. The worm gear 142 in turn rotates the shaft 134 a distance clockwise as viewed from FIG. 13B, which moves the valve part 132 to a position that covers or blocks the outlet 110 of the rear nozzle portion 92 as shown in FIG. 13B, while opening the outlet 103 of the front nozzle portion 90. Thus, suction is created in the front nozzle portion 90, when the suction motor 81 is operating, and the fluid flow path is opened to allow cleaning solution, dirt and air to flow through the duct 98 and then to the recovery tank 81. By contrast, suction is not created in the rear nozzle portion 92 and the fluid flow path for the rear nozzle portion 92 is closed, so that cleaning solution, dirt, and air do not flow through the duct 106 and outlet 110.

Figure 15:
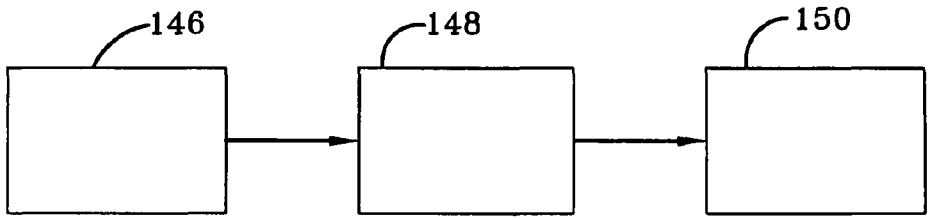
FIG. 15 is an electric block diagram of another system for controlling the valve assembly.
Figure 16A:
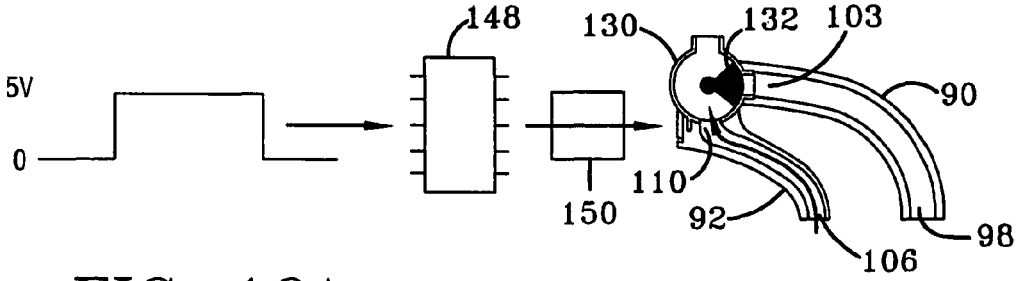
FIG. 16A is a schematic diagram showing the valve assembly being operated by the system of FIG. 15 to place it in a position that closes the front nozzle portion and opens the rear nozzle portion.

Alternatively, a micro controller could be used instead of the micro switch to control the valve part 132 and a variety of direction sensors could be used as well. For example, as seen in FIG. 15, a direction sensor 146 is coupled to the input of micro controller 148. The direction sensor 146 outputs a square pulse train having a high portion of five volts and a low portion of zero volts. When the carpet extractor 60 moves forward, this causes the high portion of the square pulse train to be inputted into the micro controller 148 as seen in FIG. 16A. This causes the micro controller 148 to output a control signal to a valve controller 150, which then places the valve part 132 in a position that blocks or covers the outlet 103 of the front nozzle portion 90.

Figure 16B:
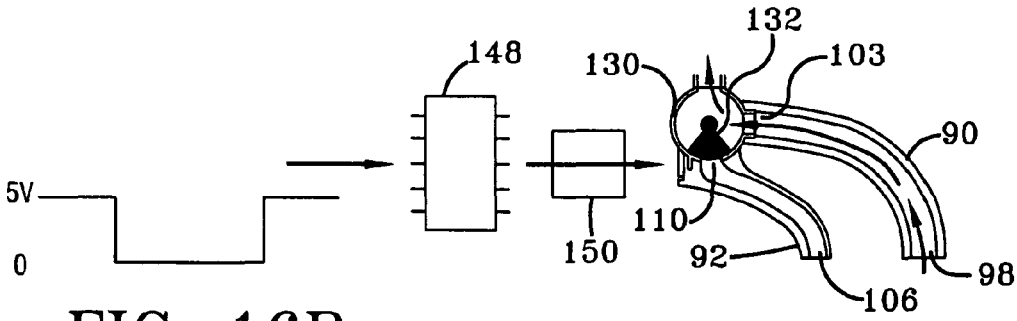
FIG. 16B is a schematic diagram showing the valve assembly being operated by the system of FIG. 15 to place it in a position that closes the rear nozzle portion and opens the front nozzle portion.
Figure 16C:
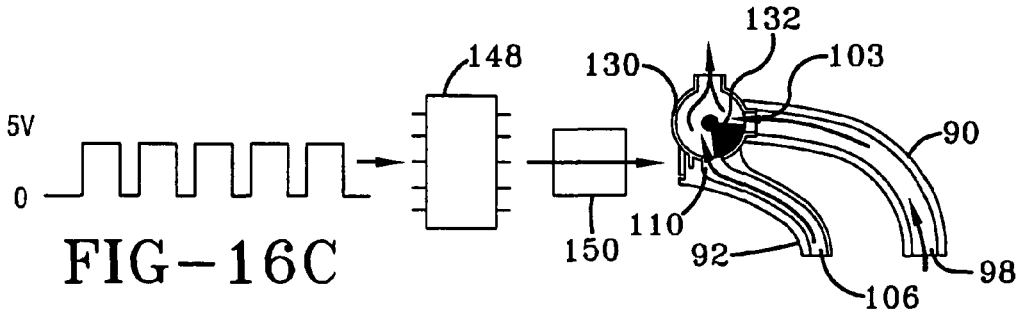
FIG. 16C is a schematic diagram showing the valve assembly being operated by the system of FIG. 15 to place it in a position that partially opens both the front and rear nozzle portions.

When the carpet extractor 60 moves rearward, this causes the low portion of the square pulse train to be inputted to the micro controller 148, which then outputs a control signal to the valve controller 150 that places the valve part 132 in a position that blocks or covers the outlet 110 of the rear nozzle portion 92 as seen in FIG. 16B. In case of rapid direction changes, the direction sensor 146 could output a voltage pulse that places the valve part 132 in a position over the outlets 103, 110 that partially covers the outlet 103 of the front nozzle portion 90 and also partially covers the outlet 110 of the rear nozzle portion 92 as seen in FIG. 16C. In particular, the valve part 132 covers about half the are each of the outlets 103, 110. Further, other mechanism to control the valve part can be used such as a stepper motor. Also, a manual override switch can be used to position the valve to cover one of the outlets 103, 110 of front nozzle portion 90 and rear nozzle portion 92 regardless if the carpet extractor 60 is moved forward or rearward.

In operation, a user pivots the handle 62 in an incline position while moving the carpet extractor 60 over the surface to clean it. The carpet extractor 60 distributes the cleaning solution to the carpeted surface, scrubs the cleaning solution using the brush assembly 112 and substantially simultaneously extracts it along with the dirt on the carpet in a continuous operation. The soiled cleaning liquid is extracted from the carpet by the suction nozzle assembly 89 and transported into the recovery tank 80 where the liquid and air are separated. A vacuum is created in the recovery tank 80 by the suction motor 81, which draws is air from the recovery tank 80 and exhausts the air to the carpeted surface.

In particular, to operate the carpet extractor using the electrical schematic diagram of FIG. 8A, a user slides the slide switch 858 of the cleaning mode switch assembly 848 upwardly to the upper end of the recess 860 to electrically connect the microswitch 836 to the main solenoid shut off valve 820. The user then moves the carpet extractor 60 forward, squeezes the trigger switch 821 to dispense the detergent mixed with water cleaning solution through the front spray bar 120. After the cleaning solution is dispensed on the cleaning surface, the brush assembly 112 scrubs it into the cleaning surface. Then, the cleaning solution mixed with dirt is extracted through the rear nozzle portion 92. After the forward stroke is completed, the user then moves the carpet extractor 60 rearwardly and squeezes the trigger 822 to dispense the clean water cleaning solution through the rear spray bar 122. After the cleaning solution is dispensed on the cleaning surface, the brush assembly 112 scrubs it into the cleaning surface. Then, the cleaning solution mixed with dirt is extracted through the front nozzle portion 90. After the rearward stroke is completed, the user then indexes or moves the carpet extractor 60 sideward to a new cleaning path adjacent the previous cleaning path and repeats the method. Alternatively, the extractor can selectively dispense the mixed detergent and clean water through both the front and rear spray bars 120, 122 or the cleaning water through both the front and rear spray bars 120, 122, if the electrical diagram of FIG. 8 is used.

The present invention has been described by way of example using the illustrated embodiments. Upon reviewing the detailed description and the appended drawings, various modifications and variations of the embodiments will become apparent to one of ordinary skill in the art. All such obvious modifications and variations are intended to be included in the scope of the present invention and of the claims appended hereto.

In view of the above, it is intended that the present invention not be limited by the preceding disclosure of the embodiments, but rather be limited only by the appended claims.

What is claimed is:

1. A cleaning machine for cleaning a surface in which cleaning solution is distributed to the surface and substantially simultaneously extracted along with dirt on the surface in a continuous operation as it moves along the surface comprising:

a) a base assembly for movement along the surface;

b) a handle portion pivotally connected to said base assembly;

c) a suction nozzle assembly mounted to said base assembly, said suction nozzle assembly including a front nozzle portion and a rear nozzle portion, said front nozzle portion defining a fluid flow path having an inlet opening and an outlet opening, said rear nozzle defining a fluid flow path having an inlet opening and an outlet opening;

d) an electrically powered suction source in fluid communication with said suction nozzle for applying suction to draw the cleaning solution and dirt from the surface and through the suction nozzle assembly;

e) a liquid distribution system associated with said base assembly for distributing the cleaning solution to the cleaning surface, the liquid distribution system further including a solution tank for holding the cleaning solution, said solution tank removably mounted to one of said base assembly and said handle portion, wherein the liquid distribution system includes at least one front distributor and one rear distributor fluidly connected to said solution tank for distributing the cleaning solution to the surface; and f) an agitator positioned intermediate the front and rear distributors, wherein one of said front distributor and said rear distributor distributes said cleaning solution in response to said base assembly moving in a forward direction and the other one of said front distributor and said rear distributor distributes said cleaning solution in response to said base assembly moving in a rear direction.

2. The cleaning machine of claim 1, wherein the fluid flow path of said front nozzle portion of said suction nozzle assembly is closed in response to said base assembly moving in one of the forward direction and rear direction, the fluid flow path of said rear nozzle portion of said suction nozzle assembly being closed in response to said base assembly moving in the other one of the forward and rear direction.

3. The cleaning machine of claim 1, wherein said liquid distribution system includes a first source providing a supply of a first cleaning solution and a second source providing a supply of a second cleaning solution, one of said front distributor and said rear distributor dispensing said first cleaning solution and the other one of said front distributor and said rear distributor dispensing said second cleaning solution.

4. The cleaning machine of claim 3, wherein said front distributor dispenses the first cleaning solution in response to said base assembly moving in the first direction and said rear distributor dispensing said second cleaning solution in response to said base assembly moving in the second direction.

5. A cleaning machine for cleaning a surface in which cleaning solution is distributed to the surface and substantially simultaneously extracted along with dirt on the surface in a continuous operation as it moves along the surface comprising:

a) a base assembly for movement along the surface;

b) a handle portion pivotally connected to said base assembly;

c) a suction nozzle assembly mounted to said base assembly;

d) an electrically powered suction source in fluid communication with said suction nozzle for applying suction to draw the cleaning solution and dirt from the surface and through the suction nozzle assembly;

e) a liquid distribution system associated with said base assembly for distributing the cleaning solution to the cleaning surface; wherein said liquid distribution system includes at least one front distributor and one rear distributor, one of said front distributor and said rear distributor distributing said cleaning solution in response to said base assembly moving in a first direction and the other one of said front distributor and said rear distributor distributing said cleaning solution in response to said base assembly moving in the second direction and, f) an agitator positioned intermediate the front and rear distributors.

6. The cleaning machine of claim 5, wherein said liquid distribution system further includes a first source providing a supply of a first cleaning solution and a second source providing a supply of a second cleaning solution, wherein said front distributor distributes the first cleaning solution in response to said base assembly moving in the first direction, said rear distributor distributing said second cleaning solution in response to said base assembly moving in the second direction.

* * * * *